US005284256A

United States Patent [19]

Correll-Antoun

[11] Patent Number: 5,284,256

[45] Date of Patent: Feb. 8, 1994

[54] CHILD'S BOOK STAND

[76] Inventor: Holly E. K. Correll-Antoun, 23986 W. Currant Dr., Golden, Colo. 80401-9214

[21] Appl. No.: 932,419

[22] Filed: Aug. 19, 1992

[51] Int. Cl.[5] ..... A47B 65/00

[52] U.S. Cl. ..... 211/42; 211/2; 211/198

[58] Field of Search ..... 211/149, 187, 198, 2, 211/42

[56] References Cited

U.S. PATENT DOCUMENTS

| | | | |
|---|---|---|---|
| 1,265,922 | 5/1918 | Lanier | 211/2 |
| 1,488,282 | 3/1924 | Phillips | 211/42 |
| 3,450,268 | 6/1969 | Sakamoto | 211/42 |
| 3,482,709 | 12/1969 | Larson | 211/187 |
| 4,779,914 | 10/1988 | Friedline | 211/198 |

OTHER PUBLICATIONS

Holbrook 1992 Early Learning Years Catalog, p. 7.

*Primary Examiner*—Kurt C. Rowan
*Assistant Examiner*—Chuck Y. Mah
*Attorney, Agent, or Firm*—William P. O'Meara

[57] ABSTRACT

A child's book stand is provided which includes a first support member, a second support member, and at least one elongated shelf which may be removably attached to either the first support member or the second support member. Each shelf has a protruding lip that extends along the front of the shelf, and each shelf is adapted for displaying a book in a forwardly facing orientation. The first support member may be removably connected to the second support member at their top and mid portions. The first support member and the second support member may also be separately mounted on a wall.

13 Claims, 2 Drawing Sheets

CHILD'S BOOK STAND

BACKGROUND OF THE INVENTION

The present invention relates generally to a child's book stand, and more particularly to a child's book stand which displays books in a forwardly facing orientation.

Children below reading age can often select their own books by looking at descriptive pictures on the front covers of books. Therefore, many children's book stands display books in a forwardly facing orientation, i.e. with the front covers of the books facing the child. Double-sided children's book stands which can display books on either side of the unit are known in the art.

However, most conventional children's book stands are not adapted to be easily altered in any significant manner in order to serve a multi-purpose function. Furthermore, children's book stands are generally constructed of a relatively heavy material such as wood and thus are not easily transportable. These conventional book stands can be supplied with caster wheels in order to facilitate moving the book stands short distances, e.g. from room-to-room, but their weight still makes it difficult for these book stands to be transported any significant distance. Such book stands are not adapted to be easily lifted in the air and mounted on a wall.

In addition, conventional book stands are typically constructed of several panels of wood which are fitted together. It is not possible for a children's book stand that is constructed of wood to be formed as an integral unit. For example, a standard wood-framed book stand is comprised of at least four separate pieces of wood (two sides, a bottom, and a back) in addition to each shelf. Thus, manufacturing and assembling a wood-framed book stand may be relatively complex and costly.

Furthermore, most conventional children's book stands have shelves which are either permanently mounted in set positions relative to one another or may be somewhat adjustable to a very limited number of positions. This restriction, in addition to being inconvenient, may limit the height of books that may be displayed. Furthermore, the depth of shelves (i.e. the approximate distance from the front of the shelf to the book stand) in conventional children's book stands is generally not adjustable in size, which may limit the thickness, as well as the height, of books that may be displayed.

OBJECTS OF THE INVENTION

It is therefore an object of the present invention to provide a child's book stand which is multi-functional.

It is another object of the present invention to provide a child's book stand which is constructed of a lightweight material and thus can be easily transported, lifted, and carried.

It is another object of the present invention to provide a child's book stand which is relatively simple and inexpensive to manufacture.

It is another object of the present invention to provide a child's book stand which can serve as either a free-standing, double-sided unit or as two separate bookcases which can each be mounted on a wall.

It is another object of the present invention to provide a double-sided child's book stand wherein each side comprises a support member that is integrally formed from a material such as molded plastic.

It is a further object of the present invention to provide a child's book stand which has shelves that adapt to varying sizes of books.

It is an even further object of the present invention to provide a child's book stand which has multiple shelves of varying depths which can be easily adjusted to a substantial number of positions relative to one another.

SUMMARY OF THE INVENTION

The present invention provides a child's book stand which may serve as either a free-standing, double-sided unit or as two separate bookcases which may each be mounted on a wall. The book stand of the present invention is also adapted to be very easily assembled or disassembled, and it is preferably constructed of a lightweight material such as molded plastic and thus may be easily transported, lifted, and carried.

The child's book stand of the present invention is adapted to display widely varying sizes of books by providing multiple shelves of different depths which can be very easily adjusted to a substantial number of positions relative to one another.

Therefore, the present invention may comprise a child's book stand comprising: a first support member having a front portion, a rear portion, a top portion, a mid portion, a front left side portion, and a front right side portion; a second support member having a front portion, a rear portion, a top portion, a mid portion, a front left side portion, and a front right side portion; at least one elongated shelf member having a front portion, a bottom portion, a left side portion, and a right side portion, said shelf member also having a protruding lip which extends along said front portion thereof, said shelf member being adapted for displaying a book in a forwardly facing orientation; shelf attachment means for removably attaching said shelf member to one of said first support member and said second support member; first connecting means for removably connecting said top portion of said first support member and said top portion of said second support member; second connecting means for removably connecting said mid portion of said first support member and said mid portion of said second support member; first mounting means for enabling said first support member to be mounted on a wall after disconnecting said first support member and said second support member; and second mounting means for enabling said second support member to be mounted on a wall after disconnecting said first support member and said second support member.

The present invention may also comprise a child's book stand comprising: a support member having a front portion, a rear portion, a top portion, a front left side portion, and a front right side portion, said front portion of said support member being spaced apart from said rear portion of said support member, said front left side portion of said support member having a plurality of shelf mounting holes therethrough, and said front right side portion of said support member having a plurality of shelf mounting holes therethrough; mounting means for enabling said support member to be mounted on a wall; at least one elongated shelf member having a front portion, a bottom portion, a left side portion, and a right side portion, said shelf member also having a protruding lip which extends along said front portion thereof, said shelf member being adapted for displaying a book in a forwardly facing orientation; and shelf attachment means for removably attaching said shelf member to said support member, said shelf attachment means comprising: at least one L-shaped member extending from said left side portion of said shelf member and at least one L-shaped member extending from said right side portion of said shelf member; wherein each of said L-shaped members extending from said left side portion of said shelf member is adapted to be received through one of said shelf mounting holes in said front left side portion of said support member, and each of said L-shaped members extending from said right side portion of said shelf member is adapted to be received through one of said shelf mounting holes in said front right side portion of said support member; and wherein said L-shaped member is removably positioned between said front portion and said rear portion of said support member.

DETAILED DESCRIPTION OF THE INVENTION

Figure 1:
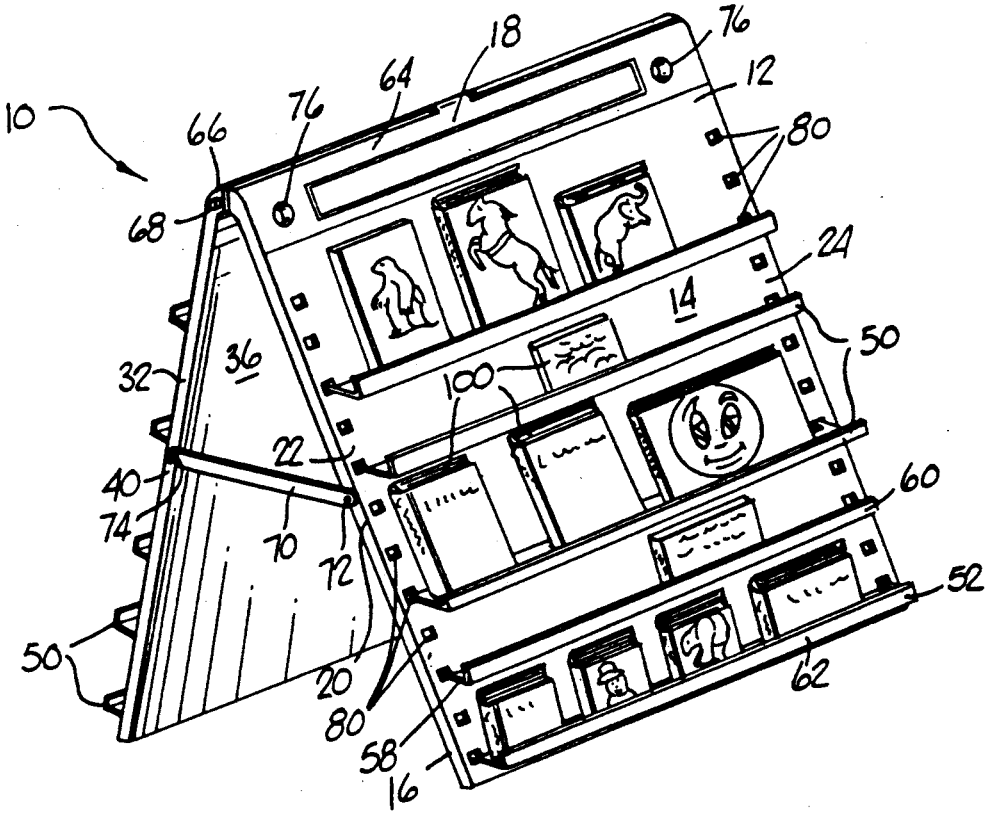
FIG. 1 is a perspective view of a child's book stand used as a double-sided, free-standing unit.
Figure 2:
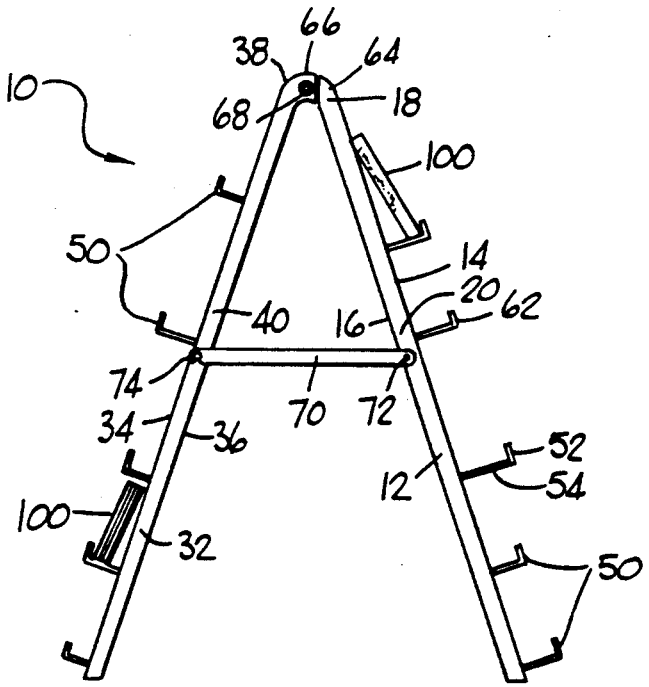
FIG. 2 is a side view of the child's book stand of FIG. 1.

As illustrated in FIGS. 1 and 2, a child's book stand 10 is provided which includes a first support member 12 having a front portion 14, a rear portion 16, a top portion 18, a mid portion 20, a front left side portion 22, and a front right side portion 24. The child's book stand 10 may also include a second support member 32, which may be substantially identical to the first support member 12, having a front portion 34, a rear portion 36, a top portion 38, a mid portion 40, a front left side portion 42 and a front right side portion 44, FIG. 3. The first support member 12 and second support member 32 may each have a height ("h", FIG. 3) of between about 36 inches and 60 inches, and preferably about 48 inches. The first support member 12 and second support member 32 may each have a width ("w", FIG. 3) of between about 24 inches and 48 inches, and preferably about 36 inches.

The child's book stand 10 further includes at least one elongated shelf member 50 which is adapted for displaying a book 100 in a forwardly facing orientation, i.e. with the front cover of the book facing outwardly. As shown in FIGS. 1 and 2, each shelf member 50 has a front portion 52, a bottom portion 54, a left side portion 58, and a right side portion 60. Each shelf member 50 also has a protruding lip 62 which extends along the front portion 52 thereof in order to aid in retaining a book 100 on the shelf 50, as best shown in FIG. 2.

As shown in FIGS. 1 and 2, the first support member 12 and the second support member 32 of the child's book stand 10 may be connected at their top portions 18, 38 and their mid portions 20, 40 to form a free-standing, double-sided unit. In a preferred embodiment, the top portion 18 of the first support member 12 may include a first hinge portion 64, and the top portion 38 of the second support member 32 may include a second hinge portion 66 (FIG. 2). The first hinge portion 64 and second hinge portion 66 are adapted to receive a removable hingepin 68.

The mid portion 20 of the first support member 12 and the mid portion 40 of the second support member 32 may be connected by at least one connecting member 70. Only one side view of the child's book stand is shown (FIG. 2), but in a preferred embodiment, identical connecting members are provided on each side of the book stand, so that both sides of the book stand 10 are substantially identical. Each connecting member 70 has a first end 72 and a second end 74. In a preferred embodiment shown in FIGS. 1 and 2, the first end 72 of the connecting member 70 may be pivotally, nonremovably attached by conventional attachment means to the mid portion 20 of the first support member 12. The second end 74 of the connecting member 70 may be removably attached by conventional attachment means to the mid portion 40 of the second support member 32. In another embodiment of the invention (not shown), the connecting member 70 may be detachable from both the first support member 12 and the second support member 32. In yet another embodiment of the invention (not shown), the connecting member 70 may comprise two separate pieces, one of which is pivotally, nonremovably attached to the first support member 12 and the other of which is pivotally, nonremovably attached to the second support member 32, the two pieces being detachable from each other. It is to be understood that the above-described attachment means or any conventional attachment means may be used to connect the first support member 12 to the second support member 32, so long as: (1) the first support member 12 is detachable from the second support member 32; and (2) the child's book stand 10 is a free-standing unit when the first support member 12 and the second support member 32 are attached.

Figure 3:
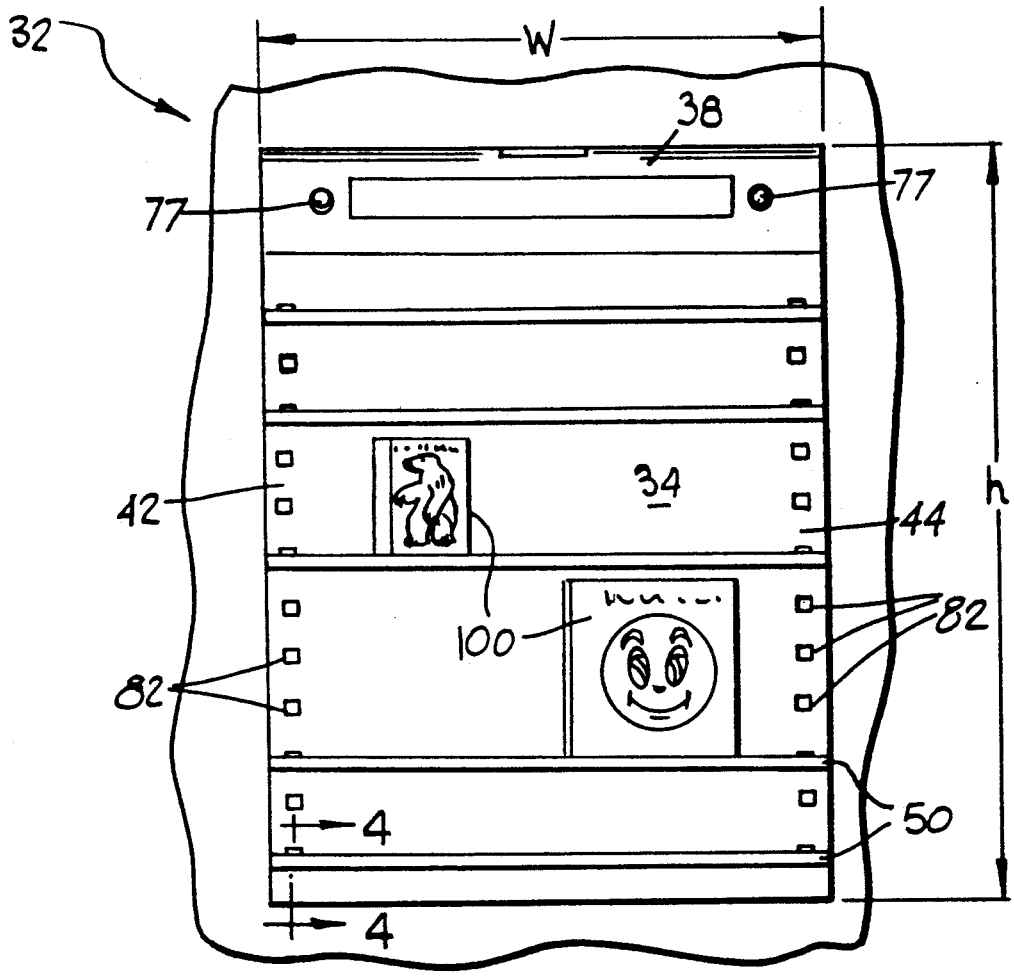
FIG. 3 is a front view of a support member of the child's book stand which has been separated from the free-standing unit and mounted on a wall.

When the first support member 12 and the second support member 32 are detached from one another at the top portions 18, 38 and mid portions 20, 40 thereof, the first support member 12 and second support member 32 may each be mounted on a wall, as illustrated in FIG. 3 (only the second support member 32 is shown). Mounting means are provided which may include wall mounting holes 76 (FIG. 1) on the first support member 12 and wall mounting holes 77 (FIG. 3) on the second support member 32 which are each adapted to receive a nail, hook, or the like protruding from the wall. The child's book stand 10 may be easily reassembled into the free-standing, double-sided unit shown in FIGS. 1 and 2 by removing each member 12, 14 from the wall and reconnecting them at the top portions 18, 38 and mid portions 20, 40 thereof.

Figure 4:
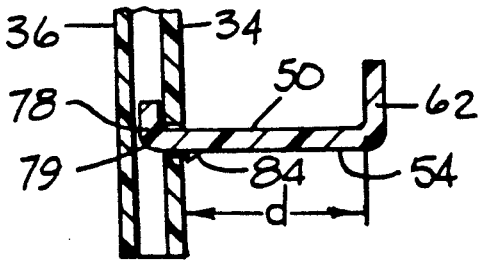
FIG. 4 is a cross sectional side view showing the attachment of a shelf member to the support member of FIG. 3.

The first support member 12, second support member 32, hinge portions 64, 66, connecting member 70, and each shelf member 50 are preferably constructed of molded plastic, which is relatively inexpensive and lightweight yet durable. This construction also provides easy assembly and disassembly of the free-standing, double-sided unit. Specifically, the light weight of the first support member 12 and second support member 32 enables each member to be easily transported, lifted, and carried, such as during disassembly of the unit and mounting of each member 12, 32 on a wall. For simplicity in manufacturing, the first support member 12 and second support member 32 are each preferably formed as single units. In addition, the first hinge portion 64 may be integrally formed with the first support member 12, and the second hinge portion 66 may be integrally formed with the second support member 32. In a preferred embodiment, both the first support member 12 and the second support member 32 are hollow so that the first support member 12 front portion 14 and rear portion 16 are spaced apart (not shown, but substantially identical to the configuration shown in FIG. 4), and the second support member 32 front portion 34 and rear portion 36 are spaced apart as shown in FIG. 4. This configuration facilitates mounting of the shelf members 50 as described below.

FIG. 4 is a cross sectional side view showing attachment of the left side 58 of a shelf member 50 to the second support member 32. It is to be understood that the attachment of both the left side 58 and right side 60 of a shelf member 50 to either the first support member 12 or the second support member 34 is substantially identical to that shown in FIG. 4. In a preferred embodiment, each shelf member 50 includes at least one L-shaped member 78 (only one shown) extending from each of the left side portion 58 and the right side portion 60 of the shelf member. A plurality of shelf mounting holes 80 (FIG. 1) are located on both the front left side portion 22 and the front right side portion of the first support member 12. Identical sets of shelf mounting holes 82 (FIG. 3) are located on the front left side portion 42 and front right side portion 44 of the second support member 32. Each of the L-shaped members 78 on the left side portion 58 of the shelf member 60 is adapted to be received in any one of the shelf mounting holes 80 on the front left side portion 22 of the first support member 12 (or front left side portion 42 of the second support member 32), and each of the L-shaped members 78 on the right side portion 60 of the shelf member 50 is adapted to be received in any one of the shelf mounting holes 80 on the front right side portion 24 of the first support member 12 (or front right side portion 44 of the second support member 32).

In mounting the left side portion 58 of a shelf member 50 to the second support member 32 as shown in FIG. 4, the L-shaped member 78 is slidingly, pivotingly received in a shelf mounting hole 82 (on the front left side portion 42 of the second support member 32, FIG. 3) and positioned between the front portion 34 and the rear portion 36 of the second support member 32. The right side portion 60 of the shelf 50 is simultaneously mounted at the opposite shelf mounting hole 82 on the front right side portion 44 of the second support member 32. A restraining member 84 which may be a small nub or the like may be positioned as shown on the shelf member bottom portion 54 near the L-shaped member 78 to limit the penetration of the L-shaped member and to provide added stability to the shelf member 50 when it is mounted in place.

With the above-described mounting arrangement, each shelf member 50 can be very easily mounted at and removed from any position along the first support member 12 or second support member 32 at which shelf mounting holes are located. It can be seen that in order to take full advantage of this adjustable shelf mounting feature, as many shelf mounting holes as possible, consistent with the structural integrity of the member, are provided on the front left and right side portions 22, 24 of the first support member 12, as well as on the front left and right side portions 42, 44 of the second support member 32.

In a preferred embodiment illustrated in FIG. 4 and described above, each shelf member left side portion 58 and shelf member right side portion 60 includes only one L-shaped member 78, although it is to be understood that more than one L-shaped member may be provided (with some adjustment to the size of the shelf mounting holes 80, 82 through which the L-shaped members 78 are received). However, in the preferred embodiment as shown in FIG. 4 in which only one L-shaped member 78 is provided on each side 58, 60 of the shelf 50, the shelf member 50, protruding lip 62, and L-shaped member 78 may be manufactured as an integral unit which has a generally U-shaped cross section and is preferably constructed of molded plastic (either hollow or solid). The shelf member may have a uniform thickness "t" (not including the restraining member 84) of, e.g., 2 inches. Each of the shelf mounting holes 80 on the front left and right side portions 22, 24 of the first support member 12, and each of the shelf mounting holes 82 on the front left and right side portions 42, 44 of the second support member 32 may be, e.g., 2.25 inches square. Each of the shelf mounting holes may be, e.g., 3.5 inches apart from center-to-center. Each of the L-shaped members 78 are preferably sized to be easily inserted and removed from each of the shelf mounting holes. In addition, the space between the front portion 14 and the rear portion 16 of the first support member 12, and the space between the front portion 34 and the rear portion 36 of the second support member 32 are preferably slightly larger than "t", e.g 2.25 inches, in order to facilitate easy insertion and removal of the L-shaped members 78. This is further accomplished by providing a rounded edge 79 on the L-shaped member 78 as shown in FIG. 4. Furthermore, preferably all of the exposed edges on the child's book stand 10 are at least slightly rounded as a safety precaution.

In a preferred embodiment of the present invention, several shelves 50 are provided that each have a depth "d" (FIG. 4) which is preferably between about 2 inches and about 5 inches. It can be seen in FIG. 2 that shelves with a depth of closer to, e.g., 2 inches are adapted to hold relatively thin books, and shelves with a depth closer to, e.g., 5 inches are adapted to hold relatively thick books or relatively tall books. Therefore, it can be seen that the present invention provides a child's book stand which has shelves that adapt to varying sizes of books. Furthermore, providing multiple shelves of different depths in combination with the adjustable shelf mounting feature described above enables the shelves to be very easily adjusted to a substantial number of positions relative to one another.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A child's book stand comprising:

a first support member having a front portion, a rear portion, a top portion, a mid portion, a front left side portion, and a front right side portion;

a second support member having a front portion, a rear portion, a top portion, a mid portion, a front left side portion, and a front right side portion;

at least one elongated shelf member having a front portion, a bottom portion, a left side portion, and a right side portion, said shelf member also having a protruding lip which extends along said front portion thereof, said shelf member being adapted for displaying a book in a forwardly facing orientation;

shelf attachment means for removably attaching said shelf member to one of said first support member and said second support member;

first connecting means for removably connecting said top portion of said first support member and said top portion of said second support member;

second connecting means for removably connecting said mid portion of said first support member and said mid portion of said second support member;

first mounting means for enabling said first support member to be mounted on a wall after disconnecting said first support member and said second support member; and second mounting means for enabling said second support member to be mounted on a wall after disconnecting said first support member and said second support member.

2. The invention of claim 1 wherein:

said front portion of said first support member is spaced apart from said rear portion of said first support member;

said front portion of said second support member is spaced apart from said rear portion of said second support member;

said front left side portion of said first support member has a plurality of shelf mounting holes therethrough, and said front right side portion of said first support member has a plurality of shelf mounting holes therethrough; and said front left side portion of said second support member has a plurality of shelf mounting holes therethrough, and said front right side portion of said second support member has a plurality of shelf mounting holes therethrough.

3. The invention of claim 2 wherein said shelf attachment means comprises:

at least one L-shaped member extending from said left side portion of said shelf member and at least one L-shaped member extending from said right side portion of said shelf member;

wherein each of said L-shaped members extending from said left side portion of said shelf member is adapted to be received through one of said shelf mounting holes in said front left side portion of one of said first support member and said second support member, and each of said L-shaped members extending from said right side portion of said shelf member is adapted to be received through one of said shelf mounting holes in said front right side portion of one of said first support member and said second support member; and wherein said L-shaped member is removably positioned between said front portion and said rear portion of one of said first support member and said second support member.

4. The invention of claim 3 wherein said shelf member and each of said L-shaped members extending therefrom are integrally formed from molded plastic.

5. The invention of claim 1 wherein said first support member is integrally formed from molded plastic, said second support member is integrally formed from molded plastic, and said shelf member is integrally formed from molded plastic.

6. The invention of claim 1 wherein said shelf member has a restraining member on said bottom portion thereof to provide added stability thereto.

7. The invention of claim 1 wherein said first connecting means comprises a first hinge portion on said first support member, a second hinge portion on said second support member, and a removable hingepin to removably connect said first hinge portion and said second hinge portion.

8. The invention of claim 1 wherein said second connecting means comprises at least one connecting member which is removably attached to at least one of said first support member and said second support member.

9. The invention of claim 1 wherein said first support member has a height of between about 36 inches and 60 inches and a width of between about 24 inches and 48 inches, and said second support member has a height of between about 36 inches and 60 inches and a width of between about 24 inches and 48 inches.

10. The invention of claim 1 wherein said first support member has a height of about 48 inches and a width of about 36 inches, and said second support member has a height of about 48 inches and a width of about 36 inches.

11. The invention of claim 1 comprising at least two elongated shelf members having different depths.

12. The invention of claim 1 wherein said shelf member has a depth of between about 2 inches and 5 inches.

13. A child's book stand comprising:

a first support member having a front portion and a rear portion, said front portion being spaced apart from said rear portion, said first support member also having a top portion, a mid portion, a front left side portion, and a front right side portion, said first support member also having a plurality of shelf mounting holes on said front left side portion thereof and a plurality of shelf mounting holes on said front right side portion thereof;

a second support member having a front portion and a rear portion, said front portion being spaced apart from said rear portion, said second support member also having a top portion, a mid portion, a front left side portion, and a front right side portion, said second support member also having a plurality of shelf mounting holes on said front left side portion thereof and a plurality of shelf mounting holes on said front right side portion thereof;

at least one elongated shelf member having a front portion, a bottom portion, a left side portion, and a right side portion, said shelf member also having a protruding lip which extends along said front portion thereof, said shelf member being adapted for displaying a book in a forwardly facing orientation;

first connecting means for removably connecting said top portion of said first support member and said top portion of said second support member;

second connecting means for removably connecting said mid portion of said first support member and said mid portion of said second support member;

first mounting means for enabling said first support member to be mounted on a wall after disconnecting said first support member and said second support member;

second mounting means for enabling said second support member to be mounted on a wall after disconnecting said first support member and said second support member; and shelf attachment means for removably attaching said shelf member to one of said first support member and said second support member, said shelf attachment means comprising:

at least one L-shaped member extending from said left side portion of said shelf member and at least one L-shaped member extending from said right side portion of said shelf member;

wherein each of said L-shaped members extending from said left side portion of said shelf member is adapted to be received through one of said shelf mounting holes in said front left side portion of one of said first support member and said second support member, and each of said L-shaped members extending from said right side portion of said shelf member is adapted to be received through one of said shelf mounting holes in said front right side portion of one of said first support member and said second support member; and wherein said L-shaped member is removably positioned between said front portion and said rear portion of one of said first support member and said second support member.

* * * * *